US011158937B2

(12) United States Patent
Kelley

(10) Patent No.: US 11,158,937 B2
(45) Date of Patent: Oct. 26, 2021

(54) METHODS AND APPARATUS OF COMMUNICATING VIA PLANAR, SURFACE MOUNTED SEMI-CIRCULAR ANTENNAS

(71) Applicant: Taoglas Group Holdings Limited, San Diego, CA (US)

(72) Inventor: Timothy Patrick Kelley, San Diego, CA (US)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 66 days.

(21) Appl. No.: 16/742,789

(22) Filed: Jan. 14, 2020

(65) Prior Publication Data

US 2020/0235474 A1 Jul. 23, 2020

Related U.S. Application Data

(60) Provisional application No. 62/795,825, filed on Jan. 23, 2019.

(51) Int. Cl.
*H01Q 1/36* (2006.01)
*H01Q 5/307* (2015.01)

(52) U.S. Cl.
CPC ..... *H01Q 1/36* (2013.01); *H01Q 5/307* (2015.01)

(58) Field of Classification Search
CPC ..... H01Q 1/36; H01Q 1/38; H01Q 9/40
See application file for complete search history.

(56) References Cited

U.S. PATENT DOCUMENTS

2004/0125020 A1* 7/2004 Hendler ..... H01Q 9/30 343/700 MS
2006/0071858 A1* 4/2006 Suh ..... H01Q 9/28 343/700 MS
2011/0074638 A1* 3/2011 Gong ..... H01Q 1/38 343/702

* cited by examiner

*Primary Examiner* — Daniel Munoz
(74) *Attorney, Agent, or Firm* — Garson & Gutierrez, PC

(57) ABSTRACT

One aspect of this disclosure provides an apparatus comprising a substrate portion and a radiating portion. The substrate portion comprises top and bottom surfaces, first and second substantially straight and parallel substrate edges, a third substantially straight substrate edge, and a fourth substrate edge having at least a curved portion. The radiating portion is disposed on the top surface of the substrate portion and is configured to radiate within a frequency range having a maximum frequency value of approximately 6 GHz. The radiating portion has first and second substantially straight and substantially parallel radiating edges, a third substantially straight radiating edge, a curved radiating edge, and a via that passes through the substrate portion and conductively couples the radiating portion to a terminal on the bottom surface. A portion of the curved radiating edge is effectively incident with air along at least the curved portion of the fourth substrate edge.

16 Claims, 5 Drawing Sheets

METHODS AND APPARATUS OF COMMUNICATING VIA PLANAR, SURFACE MOUNTED SEMI-CIRCULAR ANTENNAS

CROSS-REFERENCE TO RELATED APPLICATIONS

The present application claims priority benefit to U.S. provisional Application No. 62/795,825, filed Jan. 23, 2019 and titled METHODS AND APPARATUS OF COMMUNICATING VIA PLANAR, SURFACE MOUNTED SEMI-CIRCULAR ANTENNAS, which is incorporated by reference herein in its entirety for all purposes.

BACKGROUND

Field of the Disclosure

The present application relates generally to sub-6 GHz antenna structures that enable wireless network communications, and, more specifically, to systems, methods, and devices that utilize such antenna structures for communicating between wireless devices.

Description of the Related Art

In many telecommunication systems, communications networks are used to exchange messages among several interacting, but spatially-separated devices. Networks may be classified according to geographic scope, which could be, for example, a metropolitan area, a local area, or a personal area. Such networks would be designated respectively as a wide area network (WAN), metropolitan area network (MAN), local area network (LAN), wireless local area network (WLAN), or personal area network (PAN). Networks also differ according to the switching/routing technique used to interconnect the various network nodes and devices (e.g., circuit switching vs. packet switching), the type of physical media employed for transmission (e.g., wired vs. wireless), the set of communication protocols used (e.g. Internet protocol suite, SONET (Synchronous Optical Networking), Ethernet, etc.), and the frequency at which communications take place (e.g., 600 MHz, 2.4 GHz, 5 GHz, 6 GHz, etc.).

Wireless networks are often preferred when the network elements are mobile and thus have dynamic connectivity needs, or if the network architecture is formed in an ad hoc, rather than fixed, topology. Wireless networks employ intangible physical media in an unguided or guided propagation mode using electromagnetic waves in the radio, microwave, infra-red, optical, etc., frequency bands. Wireless networks advantageously facilitate user mobility and rapid field deployment when compared to fixed wired networks.

Antenna structures that are able to communicate at various frequencies may have various restrictions, including size, shape, susceptibility to interference, and so forth. Current antenna structures are unable to accommodate a full range of frequencies from 600 MHz to 6 GHz with a single antenna structure that is able to efficiently and effectively operate at all frequencies therebetween. Accordingly, such an antenna structure is desired for use in communication methods and apparatus.

SUMMARY

The systems, methods, and devices of the disclosure each have several aspects, no single one of which is solely responsible for its desirable attributes. Without limiting the scope of this disclosure as expressed by the claims which follow, some features will now be discussed briefly. After considering this discussion, and particularly after reading the section entitled "Detailed Description," one will understand how the features of the various aspects of this disclosure provide advantages that include improved communications between access points and stations in a wireless network.

One aspect of this disclosure provides an apparatus for wireless communications. The apparatus comprises a substrate portion and a radiating portion. The substrate portion is defined by a top surface and a bottom surface and has first and second substantially straight and substantially parallel substrate edges, a third substantially straight substrate edge coupled between the first and second substrate edges, and a fourth substrate edge having at least a curved portion. The fourth substrate edge is coupled between the first and second substrate edges and separated from the third substrate edge by the first and second substrate edges. The radiating portion is disposed on the top surface of the substrate portion and configured to radiate within a frequency range having a maximum frequency value of approximately 6 GHz, inclusive. The radiating portion has first and second substantially straight and substantially parallel radiating edges, a third substantially straight radiating edge coupled between the first and second radiating edges, and a curved radiating edge coupled between the first and second radiating edges. The radiating portion also has a via that passes from the top surface through the substrate portion to the bottom surface and conductively couples the radiating portion to a terminal on the bottom surface. The radiating portion is disposed on the top surface of the substrate portion such that at least a portion of the curved radiating edge is effectively incident with air along at least the curved portion of the fourth substrate edge.

In some aspects, the frequency range comprises one or more of approximately 500 MHz to approximately 6 GHz, inclusive, approximately 500 MHz to approximately 5 GHz, inclusive, approximately 600 MHz to approximately 6 GHz, inclusive, approximately 600 MHz to approximately 5 GHz, inclusive, approximately 700 MHz to approximately 6 GHz, inclusive, approximately 700 MHz to approximately 5 GHz, inclusive, approximately 750 MHz to approximately 6 GHz, inclusive, and approximately 750 MHz to approximately 5 GHz, inclusive. In some aspects, the substrate portion comprises a first leg having a substantially rectangular shape and a second rectangular leg having the substantially rectangular shape, the first leg substantially parallel with the first leg and the first leg separated from the second leg by the curved portion of the fourth substrate edge. In some aspects, the third radiating edge provides effective loading for the frequency range and wherein the first leg and the second leg provide mechanical support and dielectric loading at low frequencies in the frequency range.

In some aspects, dimensions of a first half of the curved portion of the substrate portion and/or of the radiating portion are defined by an equation: $y=x^3/780+x^2/25$ for $x=0 \ldots 31.5$, with an opposite half of the curved portion being a mirror image of the first half of the curved portion of the substrate portion and/or the radiating portion, respectively. In some aspects, a curve of the radiating portion is tuned to provide a maximal radiation efficiency across an operating bandwidth. In some aspects, a combination of the substrate portion and the radiating portion is unbalanced and wherein a negative element of the combination is larger than a positive element of the combination.

In some aspects, the apparatus further comprises a circuit board on which the substrate portion and the radiation portion are arranged, wherein the circuit board comprises a matching circuit electrically coupled to the radiation portion. In some aspects, the matching circuit is configured to effect one or more of a resonant frequency, a reactance, a resistance, an impedance, or a capacitance of a combination of the substrate portion and the radiating portion or the circuit board.

Another aspects of this disclosure provides a method for communicating wirelessly via an antenna structure comprising (1) a substrate portion defined by a top surface and a bottom surface, first and second substantially straight and substantially parallel substrate edges, a third substantially straight substrate edge coupled between the first and second substrate edges, and a fourth substrate edge having at least a curved portion, coupled between the first and second substrate edges, and separated from the third substrate edge by the first and second substrate edges and (2) a radiating portion disposed on the top surface of the substrate portion and having first and second substantially straight and substantially parallel radiating edges, a third substantially straight radiating edge coupled between the first and second radiating edges, and a curved radiating edge coupled between the first and second radiating edges. The method comprises conveying a drive signal to the radiating portion of the antenna structure via a transmission line coupled to a via of the radiating portion that passes from the top surface to the bottom surface through the substrate portion and generating a wireless signal via the radiating portion within a frequency range having a maximum frequency value of approximately 6 GHz, inclusive. At least a portion of the curved radiating edge is effectively incident with air along at least the curved portion of the fourth substrate edge.

In some aspects, the frequency range comprises one or more of approximately 500 MHz to approximately 6 GHz, inclusive, approximately 500 MHz to approximately 5 GHz, inclusive, approximately 600 MHz to approximately 6 GHz, inclusive, approximately 600 MHz to approximately 5 GHz, inclusive, approximately 700 MHz to approximately 6 GHz, inclusive, approximately 700 MHz to approximately 5 GHz, inclusive, approximately 750 MHz to approximately 6 GHz, inclusive, and approximately 750 MHz to approximately 5 GHz, inclusive. In some aspects, the method further comprises dielectrically loading a subset of frequencies of the frequency range via a first leg of the substrate portion, the first leg having a substantially rectangular shape, and a second leg of the substrate portion, the second leg having the substantially rectangular shape, the first leg substantially parallel with the first leg and the first leg separated from the second leg by the curved portion of the fourth substrate edge. In some aspects, the method further comprises effectively loading the frequency range via the third radiating edge.

In some aspects, a curve of the radiating portion is tuned to provide a maximal radiation efficiency across an operating bandwidth. In some aspects, a combination of the substrate portion and the radiating portion is unbalanced and wherein a negative element of the combination is larger than a positive element of the combination. In some aspects, the method further comprises matching one or more of a resonant frequency, a reactance, a resistance, an impedance, or a capacitance of a combination of the substrate portion and the radiating portion or a circuit board on which the substrate portion and the radiation portion are arranged via a matching circuit electrically coupled to the radiation portion.

In some aspects, the substrate portion comprises a supporting means and may have a top surface and a bottom surface. The supporting means may have first and second substantially straight edges that are substantially parallel, a third substantially straight edge coupled between the first and second edges, and a fourth edge having at least a curved portion, the fourth edge coupled between the first and second edges. The radiating portion may comprise a radiating means and may be disposed on the top surface of the supporting means and configured to radiate within a frequency range of 600 MHz and 6 GHz, inclusive. The radiating means may have first and second substantially straight edges that are substantially parallel, a third substantially straight edge coupled between the first and second edges, and a curved edge coupled between the first and second edges. The radiating means may further have a via that passes from the top surface through the supporting means to the bottom surface and conductively couples the radiating means to a terminal on the bottom surface, wherein the radiating means is disposed on the top surface of the supporting means such that at least a portion of the curved edge is effectively incident with air along at least the curved portion of the fourth edge of the supporting means.

BRIEF DESCRIPTION OF THE DRAWINGS

The above-mentioned aspects, as well as other features, aspects, and advantages of the present technology will now be described in connection with various aspects, with reference to the accompanying drawings. The illustrated aspects, however, are merely examples and are not intended to be limiting. Throughout the drawings, similar symbols typically identify similar components, unless context dictates otherwise. Note that the relative dimensions of the following figures may not be drawn to scale.

DETAILED DESCRIPTION

Figure 1:
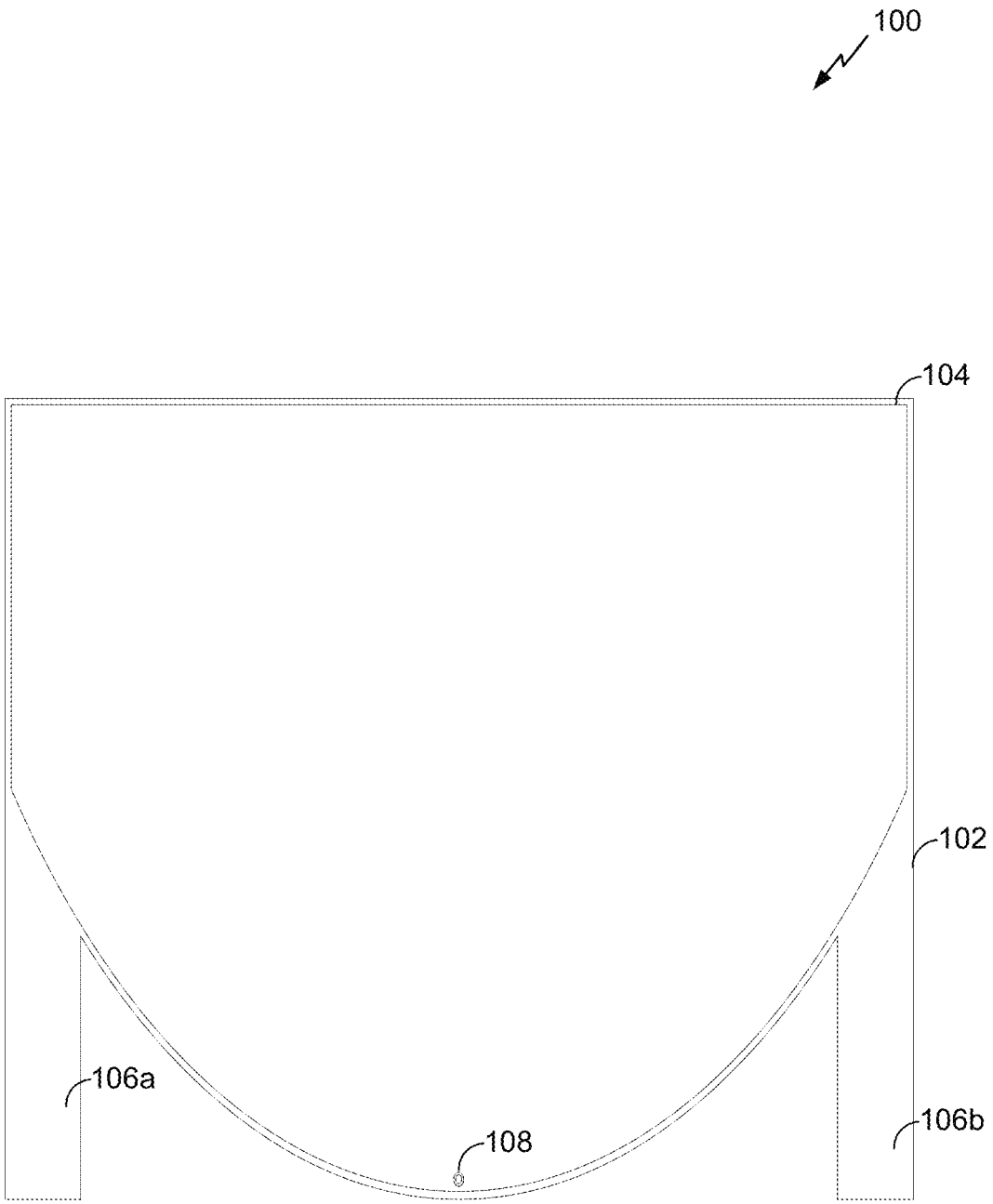
FIG. 1 illustrates a top view of one possible embodiment of an antenna structure configured to operate at any and all frequencies within a frequency range having a maximum upper limit of 6 GHz, inclusive, in accordance with an exemplary embodiment.

Various aspects of the novel systems, apparatuses, and methods are described more fully hereinafter with reference to the accompanying drawings. The teachings disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein, one skilled in the art should appreciate that the scope of the disclosure is intended to cover any aspect of the novel systems, apparatuses, and methods disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect disclosed herein may be embodied by one or more elements of a claim.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to different wireless technologies, system configurations, networks, and transmission protocols, some of which are illustrated by way of example in the figures and in the following description of the preferred aspects. The detailed description and drawings are merely illustrative of the disclosure rather than limiting, the scope of the disclosure being defined by the appended claims and equivalents thereof.

Popular wireless network technologies may include various types of wireless local area networks (WLANs). A WLAN may be used to interconnect nearby devices, employing widely used networking protocols. The various aspects described herein may apply to any communication standard, such as a wireless protocol.

In some aspects, a WLAN includes various devices which are the components that access the wireless network. For example, there may be two types of devices: access points ("APs") and clients (also referred to as stations, or "STAs"). In general, an AP may serve as a hub or base station for the WLAN and an STA serves as a user of the WLAN. For example, an STA may be a laptop computer, a personal digital assistant (PDA), a mobile phone, etc. In an example, an STA connects to an AP via a Wi-Fi (e.g., IEEE 802.11 protocol) compliant wireless link to obtain general connectivity to the Internet or to other wide area networks. In some aspects an STA may also be used as an AP.

An access point ("AP") may also comprise, be implemented as, or known as a NodeB, eNodeB, Base Station Controller ("BSC"), Base Transceiver Station ("BTS"), Base Station ("BS"), Transceiver Function ("TF"), Radio Router, Radio Transceiver, or some other terminology.

A station "STA" may also comprise, be implemented as, or known as an access terminal ("AT"), a subscriber station, a subscriber unit, a mobile station, a remote station, a remote terminal, a user terminal, a user agent, a user device, user equipment, or some other terminology. In some aspects an access terminal may comprise an Internet of Things (IoT) communication device, a mobile communications device, a handheld device having wireless connection capability, or some other suitable processing device connected to a wireless antenna and communications device. Accordingly, one or more aspects taught herein may be incorporated into a phone (e.g., a cellular phone or smartphone), a computer (e.g., a laptop), a portable communication device, a headset, a portable computing device (e.g., a personal data assistant), an entertainment device (e.g., a music or video device, or a satellite radio), a gaming device or system, a global positioning system device, a household utility meter, a position tracking device, a container tracking device, or any other suitable device that is configured to communicate via a wireless medium.

As discussed above, certain of the devices described herein may implement an IoT standard, for example. Such devices, whether used as an STA or AP or other device, may be used for smart metering or in a smart grid network. Such devices may provide sensor applications or be used in home automation. The devices may instead or in addition be used in a healthcare context, for example for personal healthcare. They may also be used for surveillance, to enable extended-range Internet connectivity (e.g. for use with hotspots), or to implement machine-to-machine communications. Although various systems, methods, and apparatuses are described herein with respect to an IoT standard, for example, a person having ordinary skill in the art will appreciate that the present disclosure is applicable to other wireless communication standards such as, for example, 802.11 standards.

Demand for higher bandwidth capability has been driving wireless communications devices with higher frequencies for many years. Frequency bands of devices have risen from megahertz (MHz) to the low gigahertz (GHz).

The 6 GHz frequency band is a licensed band often used in 5G communications, which features larger amounts of bandwidth as compared to 3G and 4G communications. The larger bandwidth means that a larger volume of information may be transmitted wirelessly. As a result, multiple applications that require transmission of a large amount of data may be developed to maximize the features of wireless communication around the 6 GHz band.

The antenna structures described herein relate to the field of surface mounted antennas in electronic devices. Previously, Long-Term Evolution (LTE) antennas or ultra-wide band (UWB) antennas (for example, in different packages with different footprints, etc.) were utilized for communications in smaller ranges and with smaller bandwidths than currently desired for 5G communication. The antenna structures described herein allow for one antenna with a single footprint that is operable in any application operating between and including the 600 MHz and 6 GHz frequencies without consuming a large amount of space on circuit boards (e.g., having relatively small footprints). Accordingly, the antenna structures described herein result in increased lower and upper frequency limits while still maintaining the same footprint and structural volume in the different applications as compared to existing antenna structures.

Enabling communications via a single antenna structure for the frequency range between, and including, 600 MHz and 6 GHz frequencies presents challenges to RF designers and engineers. For example, traditional UWB antennas are defined in terms of angle of length of a resonator of the single antenna structure. For example, a ¼ wavelength monopole may need a ¼ wavelength of physical length to radiate effectively at a frequency corresponding to the ¼ wavelength. However, the effectiveness of the antenna structure designed based on the length of the wavelength may be limited to the corresponding frequency and for frequencies loosely or generally around that corresponding frequency. However, by defining resonance in terms of angle, the corresponding antenna structure may have a defined lower frequency limit where the antenna structure also radiates effectively at higher frequencies. Therefore, by focusing on the angle of radiation rather than the length, UWB antennas can be designed having a theoretically infinite upper frequency limit, because once a largest radiation angle (and a lowest resonant frequency) has been met, then all smaller angles (and corresponding higher frequencies) are met as well. For example, when the UWB antenna produces effective and efficient radiation patterns (such as an omnidirectional pattern) at the largest angle, the UWB antenna produces effective and efficient radiation patterns at smaller angles as well.

A biconical antenna structure is a balanced antenna structure (for example, having positive and negative antenna elements that are equal in size) consisting of two conical or semi-conical shapes and fed with a drive signal (or similar signal) by a type of transmission line (for example, that conveys signals to the antenna structure). Since most commercial transmission lines are unbalanced, a balun is typically used in conjunction with the biconical antenna structure to convert the unbalanced input signal (e.g., from the transmission line) to a balanced one to match the balanced biconical antenna structure. An unbalanced antenna structure exists when the positive and negative elements of the antenna structure are not equal in size. Biconical antennas generally provide broad-bandwidth radiation ranges using two roughly conical conductive objects that almost touch at their points. For example, a bow-tie antenna is a type of biconical antenna. Such a biconical antenna provides broad-bandwidth radiation due to a traveling wave structure of the biconical antenna. However, a traditional biconical antenna may exhibit poor transmitting efficiencies at frequencies approaching a low end of its range. A monocone antenna is a monopole variation of the biconical antenna having a modified dipole shape. The monocone antenna may essentially comprise one half of a biconical antenna driven with respect to a corresponding ground plane.

In reality, UWB antennas are limited by a 50 ohm matching bandwidth. This matching bandwidth occurs between the UWB antenna and the corresponding ground plane of the circuit board. Additionally, at higher frequencies of use, losses occur in a substrate of the antenna structure (for example, the substrate that the antenna is mounted on). Such losses can become quite substantial, effectively cutting off communications at particular frequencies by reducing effective radiation, especially at higher frequencies. Often, higher cost solutions are used to avoid such losses (for example, replacing typical substrate materials with ceramic or other low loss substrate materials) to provide effective radiation at high frequencies.

The antenna structures described herein provide an ultra-wideband response in a small, low cost, and marketable package suitable for the small devices present in the IoT world. These antenna structures may be used to cover all conventional 4G LTE bands while also providing performance in many of the new bands being examined for Sub 6 GHz 5G applications. To accomplish this, the antenna structures utilize the unbalanced nature of the grounded co-planar waveguide by presenting a corresponding unbalanced antenna structure, as will be described in further detail below. Additionally, one or more sections of the antenna structure substrate material are milled out or otherwise removed in areas of high electric field to provide a radiation structure that is coincident with air at high frequencies.

FIG. 1 illustrates a top view of one possible embodiment of an antenna structure 100 configured to operate at a range of frequencies having a maximum upper limit of 6 GHz, inclusive, in accordance with an exemplary embodiment. The antenna structure 100 includes a substrate material 102, a radiating angular trace 104, first and second legs 106*a* and 106*b* formed from the substrate material, and a via 108 that conductively connects the radiating angular trace 104 to a bottom surface of the antenna structure. In some embodiments, the antenna structure 100 may be configured to operate at any range of frequencies at less than 6 GHz (for example, between approximately 500 MHz and 6 GHz, inclusive, between approximately 600 MHz and 5 GHz, inclusive, between approximately 600 MHz and 6 GHz, inclusive, between 750 MHz and 6 GHz, inclusive, and so forth). In some embodiments, frequency values within 1% of the listed frequency are considered "approximately" the same as the listed frequency. In some embodiments, frequency values within 5% of the listed frequency are considered "approximately" the same as the listed frequency.

The substrate material 102 may comprise any known substrate material used in electronics and antenna manufacturing, for example FR-4, IT-180, or any other printed circuit board (PCB) material having a dielectric constant between approximately 3.7-4.5. The radiating angular trace 104 may comprise any known trace material used in electronics and antenna manufacturing, for example copper. The via 108 may also comprise any known trace or conductive material used in electronics and antenna manufacturing, for example copper. In some embodiments, the antenna structure 100 may have a substrate material 102 width of approximately 32 mm, a thickness of approximately 1.6 mm, and a height of approximately 25 mm.

As shown, the radiating angular trace 104 covers a majority of the substrate material 102 of the antenna structure 100. The substrate material 102 is formed in a generally rectangular shape; a top edge, as shown in FIG. 1, is substantially straight. The substrate material 102 further comprises a right edge and a left edge that are substantially straight and substantially in parallel with each other and have the top edge connected therebetween. In some embodiments, the top, right, and/or left edges may have one or more other shapes so long as an amount of copper contained within an area defined by the corresponding edges (i.e., between the corresponding edges), curves, and so forth is the same such that an amount of loading provided to the antenna structure and an effect of the corresponding edges, curves, and so forth is the same as those of the antenna structure 100 shown in FIG. 1. In some embodiments, the corners where the various edges meet may be rounded, chamfered, meeting at any angle between 0 and 90 degrees or otherwise adapted such that the edges are coupled while maintaining a similar loading and/or effect to the antenna structure as if the edges meet at 90-degree angles.

A bottom edge of the substrate material 102 may have been edged, milled, or otherwise adapted to create the two legs 106*a* and 106*b* and a curved portion connected therebetween. The two legs 106*a* and 106*b* may be substantially rectangular; in some embodiments, the two legs 106*a* and 106*b* may be of any other shape and/or have different shapes or the two legs 106*a* and 106*b* of substrate material may not exist. Similarly, the radiating angular trace 104 includes a top edge that is substantially straight and that connects a right edge and a left edge that are substantially in parallel with each other. However, instead of including any leg portions, the radiating angular trace 104 may comprise a lower edge including only a curved portion. Half of the curved portions of the substrate materials 102 and/or the radiating angular trace 104 may be defined by an equation identified in Equation 1, with the other half of the curved portion being a mirror image of the first half:

$$y=x^3/780+x^2/25 \text{ for } x=0 \ldots 31.5 \qquad \text{Equation 1:}$$

The top, left, and right edges may be attached to the two terminations of this curve. In some embodiments, the combination of the top, left, right, and curved edges may form a generally rectangular shape or any other shape that maintains a similar loading and/or effect on the antenna structure 100.

At least some of the curved portion of the radiating angular trace 104 may be close coupled to the curved portion of the substrate material 102. For example, the curved portion of the radiating angular trace 104 may approach the edge of the curved portion of the substrate material 102 for the portions where they overlap. At (or substantially near) a center of the curved portion of the radiating angular trace 104 and the substrate material 102, the via 108 may be located to provide a conductive connection between the radiating angular trace 104 to a terminal located on a bottom side of the substrate material 102. The terminal that the via 108 connects to the radiating angular trace 104 may further couple to a transmission line disposed on a ground plane circuit board (not shown in FIG. 1). In some embodiments, the via 108 may be disposed substantially at the center of the curved portion of the radiating angular trace 104 to maximize performance. Such positioning of the via 108 relative to the radiating angular trace 104 may allows a largest angle to be achieved by the antenna structure 100. In some embodiments, one or more additional vias (not shown) may be used to tie top and bottom copper layers together. The transmission line may feed or convey a drive signal (or similar signal) to the via 108 and the connected radiating angular trace 104 according to which the radiating angular trace 104 may generate a wireless signal or field.

The antenna structure 100 may work similar to traditional UWB antennas, having the 50 ohm transmission line going to a connection on a bottom side of the antenna structure. The antenna structure 100 contains the via 108, which connects the connection to, for example, the 50 ohm transmission line on the bottom side of the antenna structure 100 to the radiating angular trace 104 on a top side of the antenna structure 100. However, alternative designs may be used where the orientations of the radiating trace 104, the via 108, and the transmission line are adapted to best fit a use case of the antenna structure 100. A curve of the radiating angular trace 104 may be finely tuned to provide maximal radiation efficiency across an operating bandwidth. In some embodiments, the operating bandwidth may be between 600 MHz and 6 GHz, inclusive. For example, the curve may be tuned through an iterative process of scaling a growth rate of the curve that defines the curved portion of the antenna structure 100 (for example, the curved edge of the angular radiating trace 104. For example, various values of numbers may be swept through Equation 1 to determine a best coefficient for the quadratic and cubic terms in Equation 1 of the curve that defines the angular radiating trace 104 and/or the substrate material 102. The antenna structure 100 performance is then evaluated using electromagnetic simulation software at the different rates. Once an optimal rate is achieved, this curve can be tuned via a two element matching circuit on the circuit board 200.

The antenna structure 100 may provide various benefits and advantages. For example, such antenna structures 100 may combat and/or overcome one or more of the traditional limitations of UWB antennas. For example, the antenna structure 100 may include one or more portions of substrate material 102 that are milled out or otherwise removed such that the curved length of the angular radiating trace 104 (for example, the resonator, where electric fields are highest) is (substantially) coincident with air. By making this length substantially coincident with air rather than placing an amount of lossy substrate material 102 along the length of the angular radiating trace 104 between the angular radiating trace 104 and air, radiation efficiencies at higher frequencies are improved.

The antenna structure 100 also provides a more effective 50 ohm match than most ultra-wideband antennas by leaving the antenna structure 100 itself unbalanced, rather than implementing and/or integrating a costly balun. The antenna structure 100 described herein is unbalanced because the negative element, the ground plane of a circuit board 200, is much larger than the positive element, the curved angular radiating trace 104 itself. Because the transmission line on the circuit board 200 to which the antenna structure 100 (for example, the radiating angular trace 104) is coupled is naturally unbalanced, coupling the unbalanced antenna structure 100 to the unbalanced transmission line results in a (substantially) balanced combined system without a need of introducing additional components (such as the balun).

The linear (e.g., straight) portion of the angular radiating trace 104 opposite the curved portion of the angular radiating trace 104 provides effective loading of the whole frequency range, lowering the lower frequency limit while preserving performance at all other frequencies. Furthermore, the two legs 106*a* and 106*b* of substrate material 102 on either side of the curved portion of the angular radiating trace 104 may provide both mechanical support and dielectric loading (for example, for the angular radiating trace 104) at the lowest frequencies (furthest edge of the curve) to further lower the low frequency limit. The lowest frequencies of the frequency range are the least susceptible to substrate loss; accordingly, dielectric loading provides a minimization advantage (increasing minimum frequencies available for radiation) without compromising radiation efficiency at these frequencies. Finally, implementation of a matching circuit on the circuit board 200 itself may allow the antenna structure 100 to be easily configured for various applications within its wide-bandwidth, for example, where a length of size of the circuit board 200, and thus the ground plane, is adjustable without greatly impacting radiative properties of the antenna structure 100.

Figure 2:
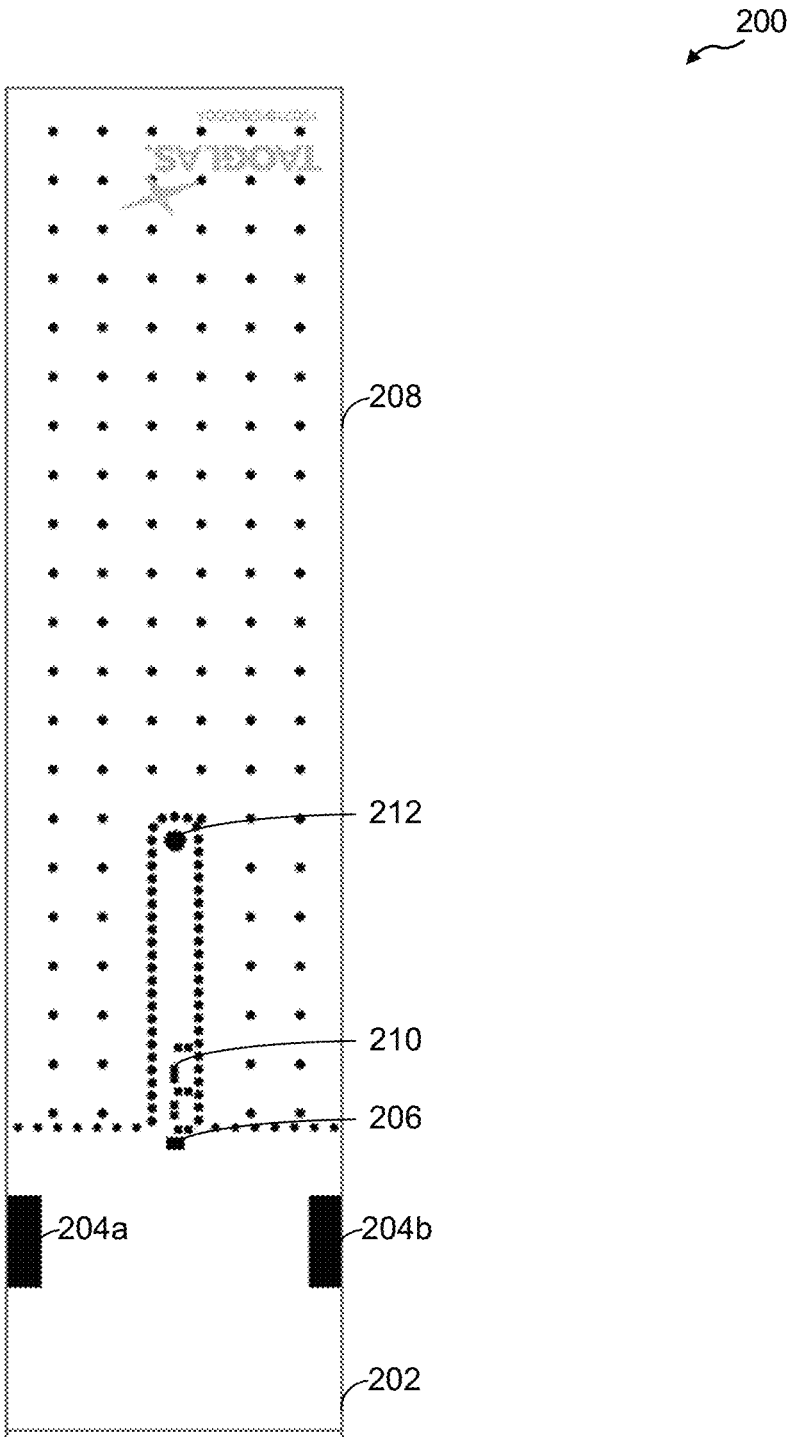
FIG. 2 illustrates a top view of one possible embodiment of a circuit board used in conjunction with the antenna structure of FIG. 1, in accordance with an exemplary embodiment.

FIG. 2 illustrates a top view of one possible embodiment of a circuit board 200 used in conjunction with the antenna structure 100 of FIG. 1, in accordance with an exemplary embodiment. As shown, the circuit board 200 comprises two portions: a first potion 202 on which the antenna structure 100 is generally disposed and a second portion 208 that generally includes any components to which the antenna structure 100 is coupled to enable radiation. In some embodiments, the first portion 202 includes two points 204*a* and 204*b* at which the antenna structure 100 is mechanically coupled to the first portion 202. In some embodiments, the antenna structure 100 includes mechanical coupling points or locations along the right and left edges of the antenna structure 100 and/or on the legs of the substrate material 102. In some embodiments, the circuit board 200 may be formed from any suitable material for circuit boards. In some embodiments, the circuit board 200 may width of approximately 136.8 mm, a thickness of approximately 0.8 mm, and a height of approximately 34 mm. In some embodiments, these dimensions can be adjusted while maintaining particular parameters, for example a ratio between the dimensions.

The circuit board 200 also includes a first terminal 206. The first terminal 206 may couple to a transmission line disposed on the circuit board 200 between the first terminal 206 and a second terminal 212 to which the transmission line is also coupled. In some embodiments, the second terminal 212 may be further coupled to a coaxial or similar connector via which the circuit board 200 and the antenna structure 100 are coupled to a receiver and/or transmission circuit. The circuit board 200 further comprises a matching circuit 210. In some embodiments, the matching circuit 210 may match properties and/or parameters of the antenna structure 100 to properties and/or parameters of the circuit board 200 to enable efficient radiation by the antenna structure 100 at all frequencies within the range 600 MHz to 6 GHz. For example, the matching circuit 210 may include one or more components that effect a resonant frequency, a reactance, a resistance, an impedance, and/or a capacitance of the antenna structure 100 and/or the circuit board 200.

In some embodiments, the circuit board 200 uses a grounded co-planar waveguide. The grounded co-planar waveguide may be unbalanced because the positive and negative elements do not have equal impedances (for example, they have different geometries). There is a positive line and then a ground that is "common" that can be used by many different circuit elements. This differs from a balanced line where there is another transmission line for the return path that has a similar geometry to the feed portion. In some embodiments, other unbalanced feed structures (microstrip, etc. co-planar waveguide without ground on the bottom) may be used to feed the antenna structure 100.

Figure 3:
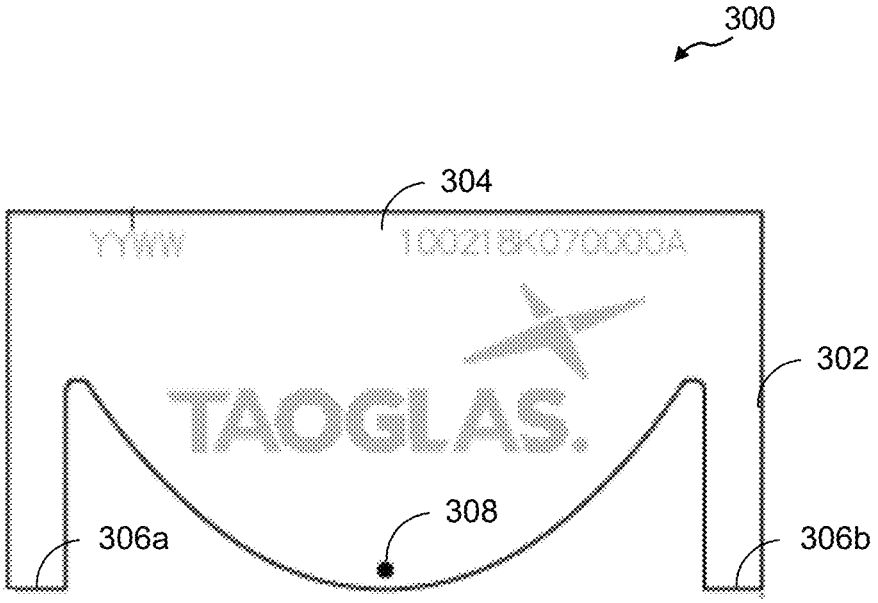
FIG. 3 illustrates a top view of an alternative antenna structure configured to operate at a reduced range of frequencies as compared to the antenna structure of FIG. 1, in accordance with an exemplary embodiment.

FIG. 3 illustrates a top view of an alternative antenna structure 300 configured to operate at a reduced range of frequencies as compared to the antenna structure 100 of FIG. 1, in accordance with an exemplary embodiment. For example, where the antenna structure 100 is configured to radiate within the frequency range of 600 MHz to 6 GHz, the antenna structure 300 may be configured to radiate within the frequency range of 790 MHz to 6 GHz. A geometry of the antenna structure 300 may be similar to a geometry of the antenna structure 100. For example, similar to the antenna structure 100, the antenna structure 300 includes a substrate material 302, a radiating angular trace 304, first and second legs 306*a* and 306*b* formed from the substrate material, and a via 308 that conductively connects the radiating angular trace 304 to a bottom surface of the antenna structure. In some embodiments, the antenna structure 300 may have a substrate material 302 width of approximately 32 mm, a thickness of approximately 1.6 mm, and a height of approximately 165 mm. In some embodiments, these dimensions can be adjusted while maintaining particular parameters, for example a ratio between the dimensions.

Both the antenna structures 100 and 300 may include a substantially curved bottom edge, two legs (106*a*-106*b* and 306*a*-306*b*, respectively) that protrude in a direction of the bottom edge, and a top edge that is substantially straight between right and left edges that are substantially parallel. However, the antenna structure 300 includes right and left edges that are shorter than the right and left edges of the antenna structure 100. The shortening of a length of the antenna structure 300 (for example, shortening the lengths of the right and left edges of the antenna structure 300 as compared to the right and left edges of the antenna structure 100) may reduce a lower limit frequency of the antenna structure 300. Thus, while the antenna structure 100 has a lower limit frequency of approximately 600 MHz, the antenna structure 300 may have a lower limit frequency of approximately 790 MHz. However, the upper limit frequency of the antenna structure 300 may not be affected by changing the lengths of the right and left edges of the antenna structure 300. The remaining functionality of the components of the antenna structure 300 is similar to those of the corresponding components of the antenna structure 100 and will not be described again here. Similarly, integration of the antenna structure 300 and the circuit board 200 will be similar to that of the antenna structure 100 and the circuit board 200, with the exception of the lower limit frequency difference between the two antenna structures 100 and 300.

In some embodiments, the antenna structures 100 and/or 300 may be provided to a customer or client on a tape and reel for surface mounting onto the circuit board 200 using a conventional pick and place method. In such embodiments, the customer or client may be responsible for also mounting the necessary components for the matching circuit 210 on the circuit board 200. In some embodiments, the antenna structures 100 and/or 300 may be provided to the customer or client already mounted to the circuit board 200 and with the matching circuit 210 already installed.

Figure 4:
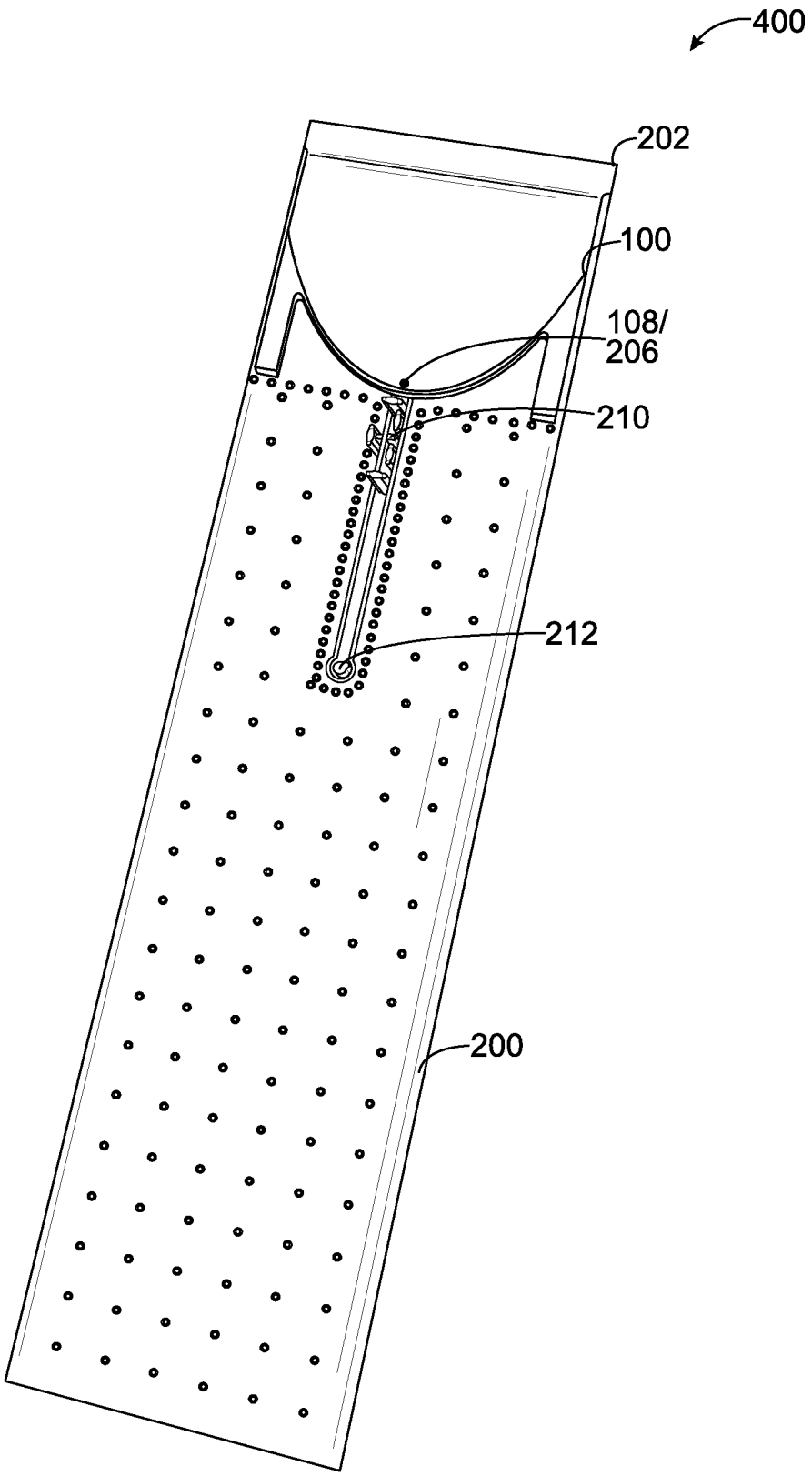
FIG. 4 illustrates a perspective view of a combination of the antenna structure of FIG. 1 with the circuit board of FIG. 2, in accordance with an exemplary embodiment.

FIG. 4 illustrates a perspective view of a combination 400 of the antenna structure 100 of FIG. 1 with the circuit board 200 of FIG. 2, in accordance with an exemplary embodiment. The combination 400 shows the antenna structure 100 disposed on the first portion 202 of the circuit board 200. The radiating angular trace 104 of the antenna structure 100 is coupled to the first terminal 206 via the via 108. Through this connection, the antenna structure 100 (and specifically the radiating angular trace 104) is coupled to the transmission line of the circuit board and effectively coupled to the second terminal 212 and the corresponding coaxial or other connector. Also shown in the combination 400 is the matching circuit 200 that adapts the parameters and/or properties of the circuit board 200 and to those of the antenna structure 100 to enable effective and efficient radiation for all frequencies within the range of 600 MHz to 6 GHz.

Figure 5:
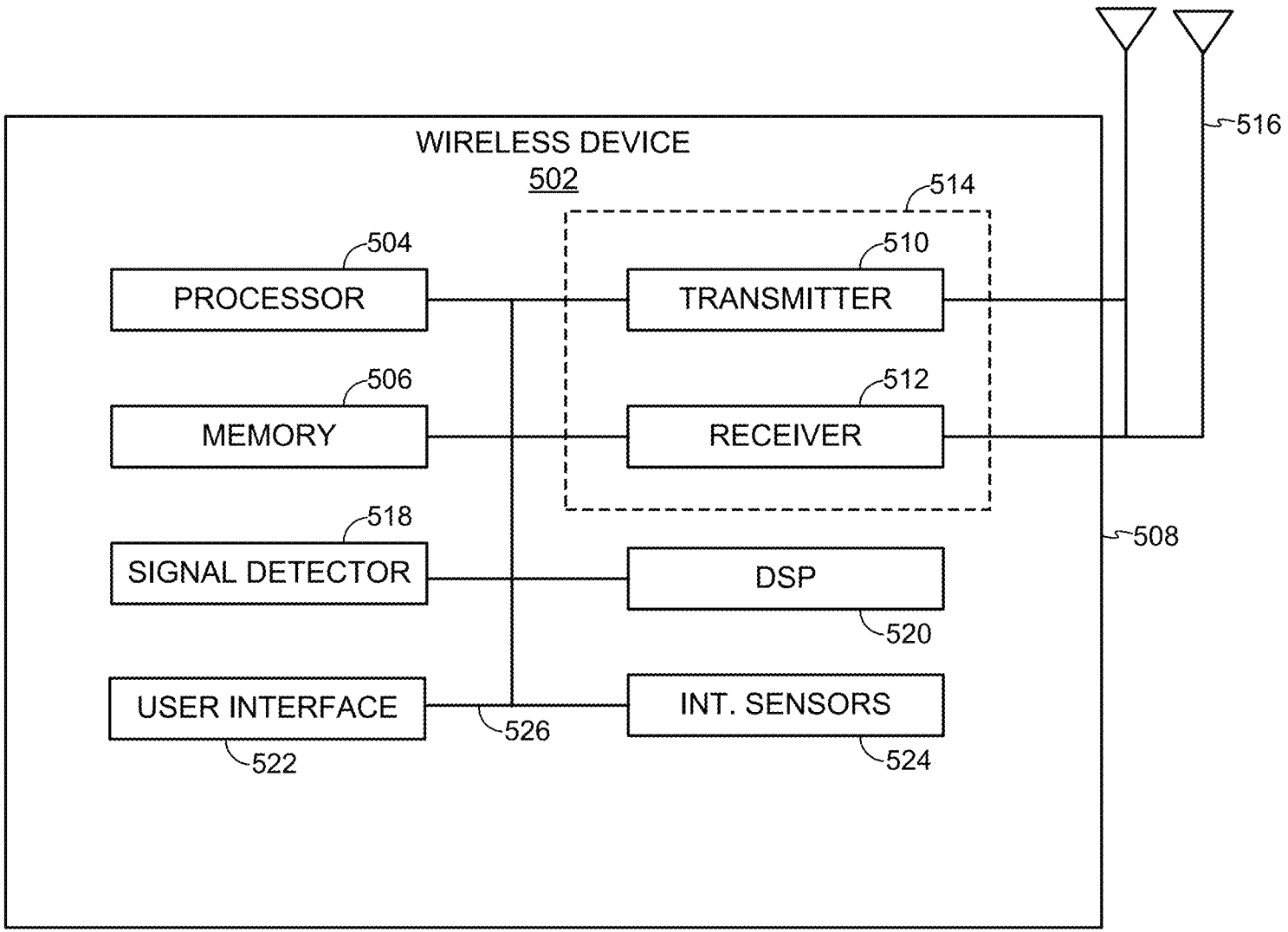
FIG. 5 illustrates a block diagram of an aspect of a device which may utilize the antenna structure of FIG. 1 to enable wireless communications, in accordance with an exemplary embodiment.

FIG. 5 illustrates a block diagram of an aspect of a device 502 which may utilize the antenna structure 100 of FIG. 1 to enable wireless communications, in accordance with an exemplary embodiment. The device 502 is an example of a wireless device that may be configured to implement the various methods described herein. For example, the device 502 may utilize one or more of the antenna structures 100 and/or 300 and the circuit board 200.

The device 502 may include a processor 504 which controls operation of the device 502. The processor 504 may also be referred to as a central processing unit (CPU). Memory 506, which may include both read-only memory (ROM) and random access memory (RAM), may provide instructions and data to the processor 504. A portion of the memory 506 may also include non-volatile random access memory (NVRAM). The processor 504 typically performs logical and arithmetic operations based on program instructions stored within the memory 506. The instructions in the memory 506 may be executable to implement the methods described herein.

The processor 504 may comprise or be a component of a processing system implemented with one or more processors. The one or more processors may be implemented with any combination of general-purpose microprocessors, microcontrollers, digital signal processors (DSPs), field programmable gate array (FPGAs), programmable logic devices (PLDs), controllers, state machines, gated logic, discrete hardware components, dedicated hardware finite state machines, or any other suitable entities that can perform calculations or other manipulations of information.

The processing system may also include machine-readable media for storing software. Software shall be construed broadly to mean any type of instructions, whether referred to as software, firmware, middleware, microcode, hardware description language, or otherwise. Instructions may include code (e.g., in source code format, binary code format, executable code format, or any other suitable format of code). The instructions, when executed by the one or more processors, cause the processing system to perform the various functions described herein. Accordingly, the processing system may include, e.g., hardware, firmware, and software, or any combination therein.

The device 502 may also include a housing 508 that may include a transmitter 510 and/or a receiver 512 to allow transmission and reception of data between the device 502 and a remote location or device. The transmitter 510 and receiver 512 may be combined into a transceiver 514. An antenna diversity system or array 516 may be attached to the housing 508 and electrically coupled to the transceiver 514. In some embodiments, one or more antennas of the antenna diversity system or array 516 may comprise one or more of the antenna structures 100 and 300. As shown, the antenna diversity system or array 516 may include 2 antennas as an example, although more than two antennas or less than two antennas are envisioned. The device 502 may also include (not shown) multiple transmitters, multiple receivers, multiple transceivers, and/or multiple antennas diversity systems. In some embodiments, the housing 508 may comprise a body of a drone or a gaming system and the antenna diversity system or array 516 may be disposed in relation to the housing 508.

The transmitter 510 can be configured to wirelessly transmit messages. The processor 504 may process messages and data to be transmitted via the transmitter 510. The receiver 512 can be configured to wirelessly receive messages. The processor 504 may further process messages and data received via the receiver 512.

The device 502 may also include a signal detector 518 that may be used in an effort to detect and quantify the level of signals received by the transceiver 514. The signal detector 518 may detect such signals as total energy, energy per subcarrier per symbol, power spectral density and other signals. The device 502 may also include a digital signal processor (DSP) 520 for use in processing signals. The DSP 520 may be configured to generate a packet for transmission.

The device 502 may further comprise a user interface 522 in some aspects. The user interface 522 may comprise a keypad, a microphone, a speaker, and/or a display, among others. The user interface 522 may include any element or component that conveys information to a user of the device 502 and/or receives input from the user. The device 502 may also comprise one or more internal sensors 524. In some aspects, the one or more internal sensors 524 may be configure to provide information to the processor 504 or any other component of the device 502.

The various components of the device 502 may be coupled together by a bus system 526. The bus system 526 may include a data bus, for example, as well as a power bus, a control signal bus, and a status signal bus in addition to the data bus. Those of skill in the art will appreciate that the components of the device 502 may be coupled together or accept or provide inputs to each other using some other mechanism.

Although a number of separate components are illustrated in FIG. 5, those of skill in the art will recognize that one or more of the components may be combined or commonly implemented. For example, the processor 504 may be used to implement not only the functionality described above with respect to the processor 504, but also to implement the functionality described above with respect to the signal detector 518 and/or the DSP 520. Further, each of the components illustrated in FIG. 5 may be implemented using a plurality of separate elements.

As used herein, the term interface may refer to hardware or software configured to connect two or more devices together. For example, an interface may be a part of a processor or a bus and may be configured to allow communication of information or data between the devices. The interface may be integrated into a chip or other device. For example, in some aspects, an interface may comprise a receiver configured to receive information or communications from a device at another device. The interface (e.g., of a processor or a bus) may receive information or data processed by a front end or another device or may process information received. In some aspects, an interface may comprise a transmitter configured to transmit or communicate information or data to another device. Thus, the interface may transmit information or data or may prepare information or data for outputting for transmission (e.g., via a bus).

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like. Further, a "channel width" as used herein may encompass or may also be referred to as a bandwidth in certain aspects.

As used herein, a phrase referring to "at least one of" a list of items refers to any combination of those items, including single members. As an example, "at least one of: a, b, or c" is intended to cover: a, b, c, a-b, a-c, b-c, aa, bb, cc, and a-b-c.

The various operations of methods described above may be performed by any suitable means capable of performing the operations, such as various hardware and/or software component(s), circuits, and/or module(s). Generally, any operations illustrated in the Figures may be performed by corresponding functional means capable of performing the operations.

The various illustrative logical blocks, modules and circuits described in connection with the present disclosure may be implemented or performed with a general purpose processor, a digital signal processor (DSP), an application specific integrated circuit (ASIC), a field programmable gate array (FPGA) or other programmable logic device (PLD), discrete gate or transistor logic, discrete hardware components, a processing system, an integrated circuit ("IC"), an access terminal, or an access point or any combination thereof designed to perform the functions described herein. A processing system may be implemented using one or more ICs or may be implemented within an IC (e.g., as part of a system on a chip). In some aspects, the IC may comprise a general purpose processor, a DSP, an ASIC, an FPGA or other PLD, discrete gate or transistor logic, discrete hardware components, electrical components, optical components, mechanical components, or any combination thereof designed to perform the functions described herein, and may execute codes or instructions that reside within the IC, outside of the IC, or both. A general purpose processor may be a microprocessor, but in the alternative, the processor may be any commercially available processor, controller, microcontroller or state machine. A processor may also be implemented as a combination of computing devices, e.g., a combination of a DSP and a microprocessor, a plurality of microprocessors, one or more microprocessors in conjunction with a DSP core, or any other such configuration.

In one or more aspects, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a web site, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk, and Blu-ray® disc where disks usually reproduce data magnetically, while discs reproduce data optically with lasers. Thus, in some aspects, computer readable medium may comprise non-transitory computer readable medium (e.g., tangible media). In addition, in some aspects computer readable medium may comprise transitory computer readable medium (e.g., a signal). Combinations of the above should also be included within the scope of computer-readable media.

Thus, certain aspects may comprise a computer program product for performing the operations presented herein. For example, such a computer program product may comprise a computer readable medium having instructions stored (and/or encoded) thereon, the instructions being executable by one or more processors to perform the operations described herein. For certain aspects, the computer program product may include packaging material.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

Further, it should be appreciated that modules and/or other appropriate means for performing the methods and techniques described herein can be downloaded and/or otherwise obtained by a user terminal and/or base station as applicable. For example, such a device can be coupled to a server to facilitate the transfer of means for performing the methods described herein. Alternatively, various methods described herein can be provided via storage means (e.g., RAM, ROM, a physical storage medium such as a compact disc (CD) or floppy disk, etc.), such that a user terminal and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the methods and apparatus described above without departing from the scope of the claims.

While the foregoing is directed to aspects of the present disclosure, other and further aspects of the disclosure may be devised without departing from the basic scope thereof, and the scope thereof is determined by the claims that follow.

What is claimed is:

1. An apparatus for wireless communications, comprising:

a substrate portion defined by a top surface and a bottom surface, the substrate portion having first and second substantially straight and substantially parallel substrate edges, a third substantially straight substrate edge coupled between the first and second substrate edges, and a fourth substrate edge having at least a curved portion, the fourth substrate edge coupled between the first and second substrate edges and separated from the third substrate edge by the first and second substrate edges; and a radiating portion disposed on the top surface of the substrate portion and configured to radiate within a frequency range having a maximum frequency value of approximately 6 GHz, inclusive, the radiating portion having:

first and second substantially straight and substantially parallel radiating edges, a third substantially straight radiating edge coupled between the first and second radiating edges, and a curved radiating edge coupled between the first and second radiating edges; and a via that passes from the top surface through the substrate portion to the bottom surface and conductively couples the radiating portion to a terminal on the bottom surface, wherein the radiating portion is disposed on the top surface of the substrate portion such that at least a portion of the curved radiating edge is effectively incident with air along at least the curved portion of the fourth substrate edge.

2. The apparatus of claim 1, wherein the frequency range comprises one or more of approximately 500 MHz to approximately 6 GHz, inclusive, approximately 500 MHz to approximately 5 GHz, inclusive, approximately 600 MHz to approximately 6 GHz, inclusive, approximately 600 MHz to approximately 5 GHz, inclusive, approximately 700 MHz to approximately 6 GHz, inclusive, approximately 700 MHz to approximately 5 GHz, inclusive, approximately 750 MHz to approximately 6 GHz, inclusive, and approximately 750 MHz to approximately 5 GHz, inclusive.

3. The apparatus of claim 1, wherein the substrate portion comprises a first leg having a substantially rectangular shape and a second rectangular leg having the substantially rectangular shape, the first leg substantially parallel with the first leg and the first leg separated from the second leg by the curved portion of the fourth substrate edge.

4. The apparatus of claim 3, wherein the third radiating edge provides effective loading for the frequency range and wherein the first leg and the second leg provide mechanical support and dielectric loading at low frequencies in the frequency range.

5. The apparatus of claim 1, wherein dimensions of a first half of the curved portion of the substrate portion and/or of the radiating portion are defined by an equation: y=x^3/780+x^2/25 for x=0 . . . 31.5, with an opposite half of the curved portion being a mirror image of the first half of the curved portion of the substrate portion and/or the radiating portion, respectively.

6. The apparatus of claim 1, wherein a curve of the radiating portion is tuned to provide a maximal radiation efficiency across an operating bandwidth.

7. The apparatus of claim 1, wherein a combination of the substrate portion and the radiating portion is unbalanced and wherein a negative element of the combination is larger than a positive element of the combination.

8. The apparatus of claim 1 further comprising a circuit board on which the substrate portion and the radiation portion are arranged, wherein the circuit board comprises a matching circuit electrically coupled to the radiation portion.

9. The apparatus of claim 8, wherein the matching circuit is configured to effect one or more of a resonant frequency, a reactance, a resistance, an impedance, or a capacitance of a combination of the substrate portion and the radiating portion or the circuit board.

10. A method for communicating wirelessly via an antenna structure comprising (1) a substrate portion defined by a top surface and a bottom surface, first and second substantially straight and substantially parallel substrate edges, a third substantially straight substrate edge coupled between the first and second substrate edges, and a fourth substrate edge having at least a curved portion, coupled between the first and second substrate edges, and separated from the third substrate edge by the first and second substrate edges and (2) a radiating portion disposed on the top surface of the substrate portion and having first and second substantially straight and substantially parallel radiating edges, a third substantially straight radiating edge coupled between the first and second radiating edges, and a curved radiating edge coupled between the first and second radiating edges, the method comprising:

conveying a drive signal to the radiating portion of the antenna structure via a transmission line coupled to a via of the radiating portion that passes from the top surface to the bottom surface through the substrate portion; and generating a wireless signal via the radiating portion within a frequency range having a maximum frequency value of approximately 6 GHz, inclusive, wherein at least a portion of the curved radiating edge is effectively incident with air along at least the curved portion of the fourth substrate edge.

11. The method of claim 10, wherein the frequency range comprises one or more of approximately 500 MHz to approximately 6 GHz, inclusive, approximately 500 MHz to approximately 5 GHz, inclusive, approximately 600 MHz to approximately 6 GHz, inclusive, approximately 600 MHz to approximately 5 GHz, inclusive, approximately 700 MHz to approximately 6 GHz, inclusive, approximately 700 MHz to approximately 5 GHz, inclusive, approximately 750 MHz to approximately 6 GHz, inclusive, and approximately 750 MHz to approximately 5 GHz, inclusive.

12. The method of claim 10, further comprising dielectrically loading a subset of frequencies of the frequency range via a first leg of the substrate portion, the first leg having a substantially rectangular shape, and a second leg of the substrate portion, the second leg having the substantially rectangular shape, the first leg substantially parallel with the first leg and the first leg separated from the second leg by the curved portion of the fourth substrate edge.

13. The method of claim 12, further comprising effectively loading the frequency range via the third radiating edge.

14. The method of claim 10, wherein a curve of the radiating portion is tuned to provide a maximal radiation efficiency across an operating bandwidth.

15. The method of claim 10, wherein a combination of the substrate portion and the radiating portion is unbalanced and wherein a negative element of the combination is larger than a positive element of the combination.

16. The method of claim 10, further comprising matching one or more of a resonant frequency, a reactance, a resistance, an impedance, or a capacitance of a combination of the substrate portion and the radiating portion or a circuit board on which the substrate portion and the radiation portion are arranged via a matching circuit electrically coupled to the radiation portion.

* * * * *